US009435099B2

(12) United States Patent
Dang

(10) Patent No.: US 9,435,099 B2
(45) Date of Patent: Sep. 6, 2016

(54) LOCKING SUBGRADE VAULT

(71) Applicant: Oldcastle Precast, Inc., Auburn, WA (US)

(72) Inventor: Nguyen Thai Dang, Madera, CA (US)

(73) Assignee: Oldcastle Precast, Inc., Auburn, WA (US)

( * ) Notice: Subject to any disclaimer, the term of this patent is extended or adjusted under 35 U.S.C. 154(b) by 0 days.

(21) Appl. No.: 14/081,829

(22) Filed: Nov. 15, 2013

(65) Prior Publication Data

US 2014/0138387 A1 May 22, 2014

Related U.S. Application Data

(60) Provisional application No. 61/727,279, filed on Nov. 16, 2012.

(51) Int. Cl.
*B65D 88/76* (2006.01)
*E02D 29/14* (2006.01)

(52) U.S. Cl.
CPC ..... *E02D 29/1427* (2013.01)

(58) Field of Classification Search
CPC .. B65F 1/1447; E05B 65/006; B65D 51/243
USPC ..... 220/484; 174/60, 37; 70/158, 391
See application file for complete search history.

(56) References Cited

U.S. PATENT DOCUMENTS 2,367,659 A 1/1945 Burke
2,693,100 A * 11/1954 Wiegel ..... E02D 29/1427 292/64
3,039,666 A 6/1962 Carpenter, Sr.
3,385,012 A 5/1968 Lovegreen
3,530,696 A 9/1970 Dunmire
3,720,251 A 3/1973 Sygnator
3,858,614 A 1/1975 Moore et al.
3,921,494 A * 11/1975 Coe ..... 411/344
3,974,599 A 8/1976 Grosh
D244,173 S 5/1977 Thurman
4,163,503 A 8/1979 McKinnon
4,204,419 A 5/1980 Cale
4,266,380 A 5/1981 Samolis
4,461,597 A 7/1984 Laurin
D279,952 S 8/1985 Daenen et al.
4,567,697 A 2/1986 Hahne
4,729,706 A 3/1988 Peterson et al.
4,797,045 A 1/1989 Lautenschlager, Jr. et al.

(Continued)

FOREIGN PATENT DOCUMENTS

EP 0529178 3/1993

OTHER PUBLICATIONS

Notice of Allowance for U.S. Appl. No. 13/294,054, mailed Jun. 23, 2014 7 pages.

(Continued)

*Primary Examiner* — Shawn M Braden
(74) *Attorney, Agent, or Firm* — Sheridan Ross P.C.

(57) ABSTRACT

A subgrade vault system with a locking lid assembly is provided. Specifically, a subgrade vault suitable for housing utility and similar equipment is provided, the vault comprising a main body portion, a cap, and a lid that may be selectively secured with one or more rotatable locking mechanisms to prevent or deter unauthorized access to vault contents.

20 Claims, 13 Drawing Sheets

(56) References Cited

U.S. PATENT DOCUMENTS

| | | | | |
|---|---|---|---|---|
| 4,844,518 | A | 7/1989 | Pritchard | |
| 4,863,059 | A | 9/1989 | Christensen | |
| 4,883,397 | A | 11/1989 | Dubost | |
| 4,897,005 | A | 1/1990 | Peterson et al. | |
| 4,911,594 | A | 3/1990 | Fisher | |
| 4,948,181 | A | 8/1990 | Pritchard | |
| 4,973,191 | A | 11/1990 | Dannhauser | |
| 4,998,332 | A | 3/1991 | Dacey, Jr. | |
| 5,026,235 | A | 6/1991 | Muller et al. | |
| 5,123,776 | A | 6/1992 | Lang et al. | |
| 5,134,758 | A | 8/1992 | Christensen | |
| 5,152,651 | A | 10/1992 | Artéon | |
| 5,176,482 | A | 1/1993 | Reinl | |
| 5,197,307 | A | 3/1993 | Abbott, Jr. | |
| 5,249,901 | A | 10/1993 | Moore | |
| 5,324,135 | A | 6/1994 | Smith | |
| 5,330,303 | A | 7/1994 | Dubost | |
| 5,378,097 | A | 1/1995 | Barnavol | |
| D355,118 | S | 2/1995 | Dickinson et al. | |
| D357,161 | S | 4/1995 | Booten | |
| D361,511 | S | 8/1995 | Dickinson et al. | |
| 5,462,383 | A | 10/1995 | Van 'T Veer | |
| 5,484,076 | A | 1/1996 | Petrushka | |
| D367,211 | S | 2/1996 | Cautereels | |
| D373,953 | S | 9/1996 | Gale | |
| D376,693 | S | 12/1996 | Wolff | |
| D379,138 | S | 5/1997 | Carlson | |
| 5,647,729 | A * | 7/1997 | de Jong et al. | 417/273 |
| D382,112 | S | 8/1997 | Egan | |
| 5,694,719 | A | 12/1997 | Bejune et al. | |
| 5,697,729 | A | 12/1997 | Bowman | |
| D394,550 | S | 5/1998 | Tanji | |
| 5,782,584 | A | 7/1998 | Arthur | |
| 5,829,215 | A | 11/1998 | Billing | |
| 5,855,461 | A | 1/1999 | Tripi | |
| 5,919,019 | A | 7/1999 | Fischer | |
| 5,951,223 | A | 9/1999 | Lindquist | |
| 5,987,824 | A | 11/1999 | Fuller | |
| D417,361 | S | 12/1999 | Mittmann et al. | |
| 6,000,576 | A | 12/1999 | Liu | |
| 6,006,414 | A | 12/1999 | Corporon et al. | |
| 6,007,270 | A * | 12/1999 | Bowman | 404/25 |
| D426,064 | S | 6/2000 | Douglas et al. | |
| 6,087,582 | A | 7/2000 | Arthur | |
| 6,106,207 | A | 8/2000 | Kuzdak, III | |
| 6,164,885 | A | 12/2000 | Roytberg et al. | |
| 6,261,039 | B1 | 7/2001 | Reed | |
| 6,283,689 | B1 | 9/2001 | Roytberg et al. | |
| D469,607 | S | 2/2003 | Wolff | |
| 6,764,261 | B1 | 7/2004 | Stadler | |
| 6,772,566 | B1 | 8/2004 | Machledt et al. | |
| 6,811,119 | B1 * | 11/2004 | Petersen et al. | 244/114 R |
| 6,899,240 | B2 | 5/2005 | Dang et al. | |
| 6,932,099 | B2 | 8/2005 | Mahaney | |
| D510,802 | S | 10/2005 | Sagol | |
| 6,953,209 | B2 * | 10/2005 | Jackson, Jr. | E05B 17/0025 16/412 |
| 7,009,513 | B2 | 3/2006 | Dang | |
| 7,030,315 | B1 | 4/2006 | Dunn et al. | |
| 7,128,495 | B1 | 10/2006 | Lill et al. | |
| D531,802 | S | 11/2006 | Zimmerman | |
| 7,163,352 | B2 | 1/2007 | Jurich et al. | |
| D547,175 | S | 7/2007 | Berg | |
| 7,385,137 | B2 | 6/2008 | Burke et al. | |
| 7,467,910 | B2 | 12/2008 | Lecuyer et al. | |
| 7,484,908 | B2 | 2/2009 | Stadler | |
| 7,500,412 | B1 | 3/2009 | Maciejewski | |
| 7,501,573 | B2 | 3/2009 | Balfour, Jr. | |
| D590,709 | S | 4/2009 | Fitzsimmons | |
| D598,197 | S | 8/2009 | Ahlstrom | |
| D606,306 | S | 12/2009 | Monte | |
| 7,748,926 | B2 | 7/2010 | Jurich et al. | |
| D622,061 | S | 8/2010 | Higginson | |
| 7,807,923 | B2 | 10/2010 | Moran | |
| 7,891,904 | B2 * | 2/2011 | Stadler | 404/25 |
| D639,065 | S | 6/2011 | Duvigneau | |
| D640,138 | S | 6/2011 | Lee | |
| D648,538 | S | 11/2011 | Reinhart et al. | |
| 8,061,928 | B2 | 11/2011 | Jurich et al. | |
| D654,693 | S | 2/2012 | Freeman | |
| 8,113,740 | B2 | 2/2012 | Boulton et al. | |
| 8,156,773 | B1 | 4/2012 | Olson et al. | |
| D662,323 | S | 6/2012 | Jurich et al. | |
| 8,302,796 | B1 | 11/2012 | Johnson | |
| D682,553 | S | 5/2013 | Jurich et al. | |
| 8,469,628 | B2 | 6/2013 | Miller et al. | |
| D696,526 | S | 12/2013 | Christensen | |
| 8,821,062 | B2 | 9/2014 | Miller et al. | |
| 9,021,842 | B2 | 5/2015 | Rix | |
| 2002/0100146 | A1 | 8/2002 | Ko | |
| 2003/0202857 | A1 | 10/2003 | Lowry et al. | |
| 2003/0206785 | A1 | 11/2003 | Hoffmann | |
| 2004/0042849 | A1 | 3/2004 | Jurich et al. | |
| 2004/0244444 | A1 | 12/2004 | Wadsworth | |
| 2007/0194493 | A1 | 8/2007 | Jurich et al. | |
| 2008/0048460 | A1 | 2/2008 | Brady et al. | |
| 2008/0095592 | A1 | 4/2008 | Spitz | |
| 2008/0159824 | A1 | 7/2008 | Okada et al. | |
| 2008/0169392 | A1 | 7/2008 | McClure et al. | |
| 2008/0226417 | A1 | 9/2008 | Spitz | |
| 2008/0247842 | A1 | 10/2008 | Motsch et al. | |
| 2009/0226260 | A1 | 9/2009 | Boulton et al. | |
| 2010/0040433 | A1 | 2/2010 | Poppe et al. | |
| 2010/0132168 | A1 | 6/2010 | Coffland et al. | |
| 2010/0296865 | A1 | 11/2010 | Jurich et al. | |
| 2010/0310338 | A1 | 12/2010 | Diez Herrera | |
| 2010/0329782 | A1 | 12/2010 | Miller et al. | |
| 2011/0203334 | A1 * | 8/2011 | Rix | 70/158 |
| 2012/0073106 | A1 | 3/2012 | Jurich et al. | |
| 2012/0111866 | A1 | 5/2012 | Freeman | |
| 2012/0228302 | A1 | 9/2012 | Byrns | |
| 2013/0205674 | A1 | 8/2013 | Damon | |
| 2013/0248534 | A1 | 9/2013 | Dang | |
| 2013/0263425 | A1 | 10/2013 | Miller et al. | |
| 2014/0138387 | A1 | 5/2014 | Dang | |

OTHER PUBLICATIONS

Brooks Products Meter Boxes and Pull Boxes, drawing revision date Dec. 6, 2000, 17 pages.

Brooks Products Meter Boxes and Pull Boxes, drawing revision date Jan. 9, 2001, 4 pages.

Applicant's Admitted Prior Art: Eisel Enterprises Inc. Precast Concrete Products, date unknown, 21 pages.

Applicant's Admitted Prior Art: US Concrete Precast Group Products, date unknown, 9 pages.

Notice of Allowance for Design U.S. Appl. No. 29/378,870, mailed Nov. 4, 2011, 9 pages.

Notice of Allowance for Design U.S. Appl. No. 29/386,380, mailed Feb. 29, 2012, 9 pages.

Official Action for Design U.S. Appl. No. 29/424,306, mailed Sep. 13, 2012, 7 pages.

Notice of Allowance for Design U.S. Appl. No. 29/424,306, mailed Jan. 7, 2013, 5 pages.

Official Action for U.S. Appl. No. 13/294,054, mailed Feb. 27, 2014 11 pages.

Official Action for U.S. Appl. No. 14/486,662, mailed Mar. 27, 2015 7 pages.

Notice of Allowance for U.S. Appl. No. 14/486,662, mailed Jul. 8, 2015 9 pages.

Official Action for U.S. Appl. No. 13/851,809, mailed Mar. 27, 2015 7 pages.

U.S. Appl. No. 14/925,561, filed Oct. 28, 2015, Freeman.

Official Action for U.S. Appl. No. 14/486,662, mailed Mar. 14, 2016 14 pages.

* cited by examiner

SECTION A-A

LOCKING SUBGRADE VAULT

This U.S. Non-Provisional Patent Application claims the benefit of priority from U.S. Provisional Patent Application No. 61/727,279, filed Nov. 16, 2012, the entire disclosure of which is hereby incorporated by reference in its entirety.

FIELD OF THE INVENTION

The present disclosure relates generally to vaults for providing an enclosed region beneath a ground surface. More specifically, vaults are provided comprising a locking lid with a cap assembly for securing various electrical, water, communications and other components and systems below grade of ground level.

BACKGROUND OF THE INVENTION

Subgrade vaults are widely used to provide internal enclosed regions where connections can be made and housed. Classic examples of such connections are the joinder of electrical cables used in street lighting, in telephone and communication systems, and water valves for residential communities and golf courses. Such vaults are generally placed below grade of ground level with their upper surfaces at grade where loads from pedestrians and vehicles, as well as environmental factors such as the presence of precipitation and animals are anticipated. Generally the vaults will be used by and allow access to municipalities, utility companies, and other installations where longevity of the vaults, and affordability are important. Although subgrade vaults are typically comprised of precast or poured-in-place concrete, alternative materials such as fiberglass, plastic, and other materials may be used and the present invention is not limited to any given material.

Vault systems and devices are intended for access and interaction with trained professionals who, for example, need to service complex, dangerous, and/or valuable subgrade systems to maintain vital infrastructure. Accordingly, in addition for these devices and systems to withstand various forces and abuse due to environmental conditions, it is desirable to provide systems that allow for general ease of access to the appropriate individuals, while simultaneously preventing unauthorized access. A lid for providing access to an enclosed subgrade region must not only be structurally sound, but must be simple to remove and replace, while reliably holding the lid onto the body when access is not needed.

Subgrade storage systems generally contain and/or provide access to valuable components necessary in performing critical functions and/or with respect to monetary value. In part due to the high commodity prices of metals and other internal components, theft is an increasing problem which is not only expensive but extremely disruptive when communication, electrical or water service is discontinued. Furthermore, improperly secured or physically damaged subgrade systems may present hazardous conditions to passer-bys and professionals alike. Currently known systems fail to provide adequate safety and security measures for preventing and/or deterring unauthorized access to subgrade storage areas.

SUMMARY OF THE INVENTION

There has thus been a long-felt but unmet need to provide a subgrade vault system having features adapted for securing at least a lid portion to additional system components, such as a vault cap. The following references relate to the field of subgrade storage vaults and facilities and are hereby incorporated by reference in their entireties: U.S. Pat. No. 4,567,697 to Hahne, U.S. Pat. No. 6,772,566 to Machledt et al., U.S. Pat. No. 6,899,240 to Dang et al., U.S. Pat. No. 7,163,352 to Jurich et al., U.S. Pat. No. 7,385,137 to Burke et al., U.S. Pat. No. 7,467,910 to Lecuyer et al., and U.S. Pat. No. 7,748,926 to Jurich et al. Co-owned and co-pending U.S. patent application Ser. No. 13/294,054, filed Nov. 10, 2011 is also hereby incorporated by reference in its entirety.

It is one object of the present invention to provide for an improved subgrade or above grade vault system having locking or selectively securing features to prevent unwanted access to an enclosed region. It is another object of the present invention to provide a concrete enclosure adapted for containing subgrade systems wherein the concrete enclosure comprises a lid which can be secured when the lid is generally in a closed or sealed position, thus preventing unwanted or unauthorized access to contents of the enclosure.

It is another object of this invention to provide an improved subgrade vault, with cost effective manufactured components to selectively secure an enclosure. In various embodiments, the present invention comprises a cap adapted to be connected or secured to a concrete box or structure for containing, enclosing, and/or securing subgrade utility components. In one embodiment, the present invention comprises a plastic cap formed to or connected with a quantity of concrete, the concrete having a height extending downwardly from the plastic cap, a generally polygonal or rectangular shape, and a predetermined thickness. In one embodiment, the quantity of concrete comprises a top portion to which a cap is formed or attached and a bottom portion that is generally open. In an alternative embodiment, the present invention comprises a quantity of concrete comprising four side walls and a bottom portion, such that the device comprises a fully contained enclosure when a lid, as will be described in further detail, is placed on or connected to a top portion.

In various embodiments, precast concrete is used to form portions of a subgrade storage vault, as precast concrete is generally known to provide a substance that is simultaneously rigid and strong enough to accommodate various compressive and shear loading that a subgrade vault is likely to experience. However, it is to be expressly understood that the present invention is not limited to embodiments comprising precast concrete. Indeed, any rigid material determined to be economically feasible for use in subgrade storage vaults may be used to form the body and/or peripheral walls of a lockable subgrade storage vault in accordance with the present invention. For example, in various embodiments, a lockable subgrade vault structure is provided wherein various components comprise cellular concrete, polyethylene, polypropylene, polyvinyl chloride, nylon, polycarbonate, aluminum, acrylonitrile butadiene styrene, acetal, acrylic, epoxy, fluorocarbons, lonomer, polybutylene, polyester, polystyrene, silicone, various combinations thereof and various similar materials thereto.

In various embodiments, the present invention comprises a subgrade storage facility wherein a molded plastic cap is first formed and a main body comprising four walls is formed or extruded therefrom. In a particular embodiment, the present invention comprises an injection molded, rotomolded or blow-molded plastic cap and a main body portion comprises precast concrete and a method of making the same. In one embodiment, the present invention comprises an injection molded cap adapted for receiving a locking device, wherein at least a portion of the locking device is secured to the cap and/or body upon extrusion or creation of the body portion from the cap. For example, a cap may be provided comprising four sides, each of said four sides having a width approximately corresponding to a width of a sidewall of a main body portion to be extruded or extended therefrom.

In various embodiments, lids for covering and securing a vault area provided. The lids comprise one or more adjustable members, the adjustable members adapted for being selectively positioned in at least two positions where a first position corresponds to an unlocked state and a second position corresponds to a locked or secured state. For example, in one embodiment, at least one substantially rigid member is provided on a bottom or underside of the lid. The substantially rigid member is rotatably secured to the lid by, for example, at least one hinge. Rotation of the substantially rigid member about the at least one hinge transitions the member between a locked position and an unlocked position. The locked position is generally characterized by a rotational or angular position of the member wherein the member contacts a portion of the vault and substantially limits or prohibits movement of the lid in at least one direction (e.g. the vertical direction). The unlocked position is generally characterized by a rotational or angular position of the member wherein the member does not contact the vault and thus does not inhibit movement of the lid at least in one direction. In certain embodiments, a corresponding vault is provided in combination with the lid, the vault comprising preferred internal dimensions to operatively interact with features of the lid. For example, in one embodiment, internal side walls of the vault comprise a sloped or tapered arrangement such that provision of the substantially rigid member(s) in a first position results in contact and/or an interference fit between the member(s) and side wall(s) such that the lid may not be removed. Similarly, provision of the member in a second position results in the absence of such contact or fit and renders the lid capable of lifted vertically and removed.

While various embodiments of the present disclosure contemplate tapered internal surfaces of a vault or storage area, alternative arrangements are also contemplated. For example, in one embodiment, a recession is provided on at least one internal surface of a vault corresponding to at least one substantially rigid member, the recession provided to receive at least a portion of the substantially rigid member and prevent movement of the lid. Alternatively, a projection may be provided on an internal surface of the vault to perform substantially the same function as the recession. Projections and recessions may be provided along only a portion of a perimeter of the vault or may extend around the entire perimeter or circumference.

In various embodiments, the position (e.g. the angular position) of the at least one substantially rigid member is adjustable from above (i.e. the top side) of the lid. Adjustment features including, for example, threaded members are provided through the lid. At least a portion of the adjustment member is accessible from a surface level or top portion of the lid to adjust enclosed or subgrade members.

In various embodiments, a locking member is provided comprising one or more apertures for accessing one or more locking features. For example, in one embodiment, a locking member comprises a substantially rigid member hinged at one end and a threaded member located distal from the hinge. The threaded member is rotatable about an axis and useful for rotating the substantially rigid member about the hinge.

In one embodiment, a locking member comprises two substantially rigid members each hinged and rotatable about two points. The embodiment comprises a single centralized adjustment member comprising a threaded member and translatable features.

It is to be expressly understood that various locking members may achieve objects of the present invention and, as such, the present invention contemplates numerous variations of the locking members as shown and described herein. These variations, as will be recognized by one of ordinary skill in the art include, but are not limited to variations within size, shape, orientation, material, and quantity of locking members that are provided. It will also be expressly understood that various embodiments of locking members as described herein may be provided either in isolation or in combination with various other contemplated locking members or features.

Locking members of the present invention may be comprised of any material known to provide sufficient strength properties and combinations thereof. Accordingly, although a preferred embodiment contemplates a metal locking mechanism disposed within a concrete main body portion and a plastic cap, the present invention is not limited to any such embodiment.

In various embodiments, the present invention comprises a lid adapted to be secured to a cap and vault structure. In one embodiment, a lid of the present invention comprises a combination of plastic and a concrete material, wherein an outer portion of the lid is generally comprised of plastic to accommodate stress concentrations at specific locations and generally prevent or reduce the risk of chipping and cracking at corner and perimeter regions of the lid. An inner or central portion is generally comprised of a concrete material, such as Portland cement or precast concrete adapted for accommodating anticipated static and dynamic loading known to be experienced by a subgrade vault with a lid.

In one embodiment, a lid of the present disclosure comprises at least one aperture or through-hole and an optional cap, lid, or cover, for selectively sealing the same. The aperture or through-hole is formed such that a rotatable member is received herein, the aperture providing a point of access for the rotatable member and actuating system components shown and described herein. Accordingly, when a lid is placed on or within a cap of the present invention, an enclosed vault region is established, with access to a locking member(s) provided through an aperture formed in the lid. Thus, when a lid is placed upon a subgrade vault, the lid may be further secured and/or locked to additional components via one or more fasteners. For example, in one embodiment, once a lid is placed upon a cap, one or more apertures formed in the cap provide above-grade access for a threaded fastener such as a bolt to be secured to a female threaded portion. In various embodiments, cap or cover features are provided to cover or conceal apertures and locking hardware formed in a lid, thus providing a generally flush lid surface for improving aesthetic and safety characteristics of the lid.

In various embodiments, unauthorized access to an internal volume of a subgrade vault is prevented or at least minimized through the use of tamper-proof fasteners. For example, lids of the present invention may be secured to caps, vaults, and/or additional components through the use of one or more tamper-proof fasteners. One of skill in the art will recognize that a wide variety of known or custom-made tamper-proof fasteners may be employed in embodiments of the present invention, such that an ordinary passerby or potential pillager is unlikely to possess the requisite tool for removing/loosening the fastener. By way of example only, tamper-proof fasteners suitable for use in the present invention include, but are not limited to those available through Tamperproof Screw Company, Inc.

In one embodiment, the present invention comprises a subgrade vault having a lid with a single aperture formed in a corner of the lid and corresponding to a locking member formed in a cap/vault portion for securing the lid to the vault. In an alternative embodiment, the present invention comprises a lid having a plurality of apertures in a plurality of corners of the lid, each of the apertures corresponding to a subgrade locking mechanism for securing the lid to the cap/vault.

In various embodiments, the present invention comprises a lid with one or more apertures and corresponding subgrade locking mechanism(s) disposed in a central region of the lid and vault opening. For example, in a particular embodiment, the present invention comprises a lid with an aperture disposed in a central region of the lid and a locking mechanism spanning across a dimension of the cap and providing a point of attachment for the lid within a central region of the lid, or alternatively on one or more edges of the cap.

In various embodiments, the present invention comprises one or more apertures having removable features for selectively viewing or accessing a subgrade feature, such as a meter. For example, in one embodiment, a lid is provided having a removable feature adapted for being selectively removed from a remainder of the lid such that subgrade features, such as a water meter, may be read without the need for complete removal of the lid. In various embodiments, the removable feature or features comprise pry-off lids or caps adapted to be removed and applied with relative ease to observe or read one or more subgrade features. In alternative embodiments, caps or lids for observing subgrade features comprise securing features, such as tamper-proof fasteners as previously described.

In various embodiments, subgrade vault lids are provided having one more plates or portions adapted to display information. For example, in one embodiment, a composite plastic and concrete cover is provided having a plastic name plate for displaying general information related to the contents of the vault (e.g. "ELECTRICAL," "WATER," "GAS," etc.)

In one embodiment, a method of forming a subgrade concrete vault is provided comprising: (1) placing a locking member on the underside of a pre-formed plastic cap by aligning pre-formed plastic pins of said plastic cap through the corresponding holes provided in the locking element and applying a force to the locking element; (2) placing the plastic cap and locking member into a precast mold or on a vibrating table with a jig to align the cap with mold; (3) optionally inserting a sizing ring into the plastic cap; (4) pouring a concrete into a mold, wherein at least one boundary of the mold is defined by the cap; (5) verifying that the plastic cap and locking element have not been damaged; (6) placing the product into a kiln and curing the product; (7) removing the product from the kiln and verifying that it is ready to be shipped and/or sold. After forming, a concrete vault is provided with an integral plastic cap which includes a bracket embedded in the concrete vault and which is adapted to receive hardware such as a bolt which secures the lid to the cap and requires a special tool.

In one embodiment, a method of securing a lid to a subgrade concrete vault structure is provided, the method comprising: (1) placing a lid on a cap portion of a subgrade vault; (2) verifying that an aperture of the lid is generally aligned with a threaded aperture of a locking mechanism attached to a the subgrade vault; (3) where an aperture of the lid is not generally aligned with a threaded aperture of a locking mechanism, removing the lid, adjusting the location of the threaded aperture of the locking mechanism, and replacing the lid; (4) inserting and applying torque to a tamper-proof fastener until the fastener secures the lid to the vault via contact between a portion of the fastener with a portion of the lid and threaded attachment to the threaded aperture in the locking mechanism.

In various embodiments, a subgrade vault for providing an enclosed region to house utility connections is provided, the vault comprising a body portion having four side walls which define an enclosure, each of the four side walls having a predetermined thickness, an upper end, and lower end, and a perimeter of the upper end being less than a perimeter of the lower end; a cap member interconnected to the upper end of at least one of the four side walls; and a lid for closing the upper end, the lid comprising a top surface and a bottom surface and the bottom surface comprising at least one substantially rigid locking feature rotatable between a first position and a second position.

In one embodiment, a lid for a subgrade vault providing an enclosed region to house utility connections is provided, the lid comprising an upper surface and a lower surface, and a predetermined length, width, and height; locking means for releasably securing the lid to the vault, the locking means comprising at least rotatable member provided on the lower surface of the lid; the at least one rotatable member having a predetermined length and rotatable between at least a first unlocked position and a second locked position, the second locked position characterized by a distal end of the at least one rotatable member being in force transmitting communication with an interior surface of said vault.

In certain embodiments, a locking lid is provided comprising a selectively rotatable locking element, the locking element being disposed substantially below-grade but being accessible and/or rotatable from a top surface area of the lid. The locking element comprises a downwardly extending shaft portion which extends substantially perpendicularly to a top and bottom surface of the lid. The downwardly extending shaft portion comprises an extension, the extension extending substantially perpendicularly to the shaft portion and substantially parallel to the top and bottom surfaces of the lid. A proximal portion of the shaft is provided proximal the upper surface of the lid, and the locking element is rotatable by applying a rotational force to the proximal portion. The extension may be rotated into force-transmitting contact with anyone of the four side walls of the vault. It is further contemplated that indicia may be provided on the proximal portion and/or the lid, for example, to indicate whether a rotational position of the proximal portion corresponds to a locked or unlocked position of the locking element; a locked position characterized in that the extension is in force-transmitting contact with a sidewall and prevents removal of the lid and an unlocked position characterized in that the extension is not in contact with a side and lifting or removal of the lid is not impacted by the locking element.

In one embodiment, a shaft portion comprising an extension also comprises a biasing feature. For example, in one embodiment, a proximal head of the shaft portion comprise a coil spring that biases the shaft portion and associated extension upwardly. To rotate the shaft portion and move the locking element between a locked and unlocked position, a user may push and turn the proximal end of the shaft, thereby compressing the spring and enabling rotation. The proximal head may comprise a bolt head or similar device, such as those which accept a flathead or Phillips head screwdriver.

Caps of the present disclosure generally comprise a plastic material or fiberglass and the main body portion comprises a concrete material. Vaults of the present disclosure generally comprise an open center portion which is bounded by four sidewalls of the main body portion and is generally open at a top and bottom. In various embodiments, a main body portion is formed of concrete by placing a plastic cap in a generally up-side down position and pouring a quantity of concrete onto the cap via a mold or guide. The cap is sealed to the concrete with numerous projections which extend into the concrete. Thus, in various embodiments, the wall thickness of a main body portion of the present invention is approximately equal to a cap width as shown and described.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. Further details and other features will become apparent after review of the following Detailed Description and accompanying drawing figures.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
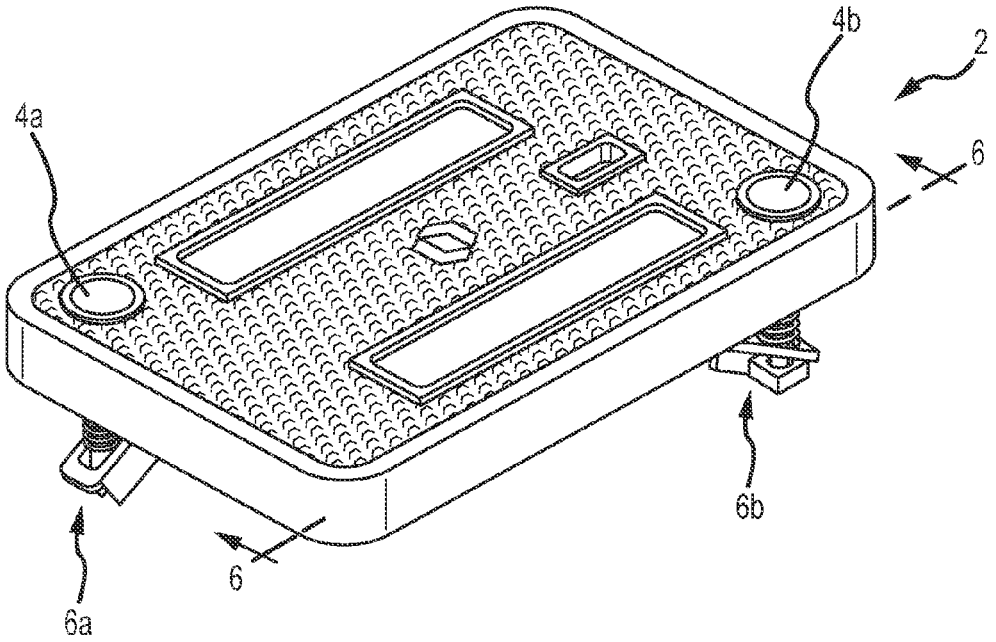
Figure 2:
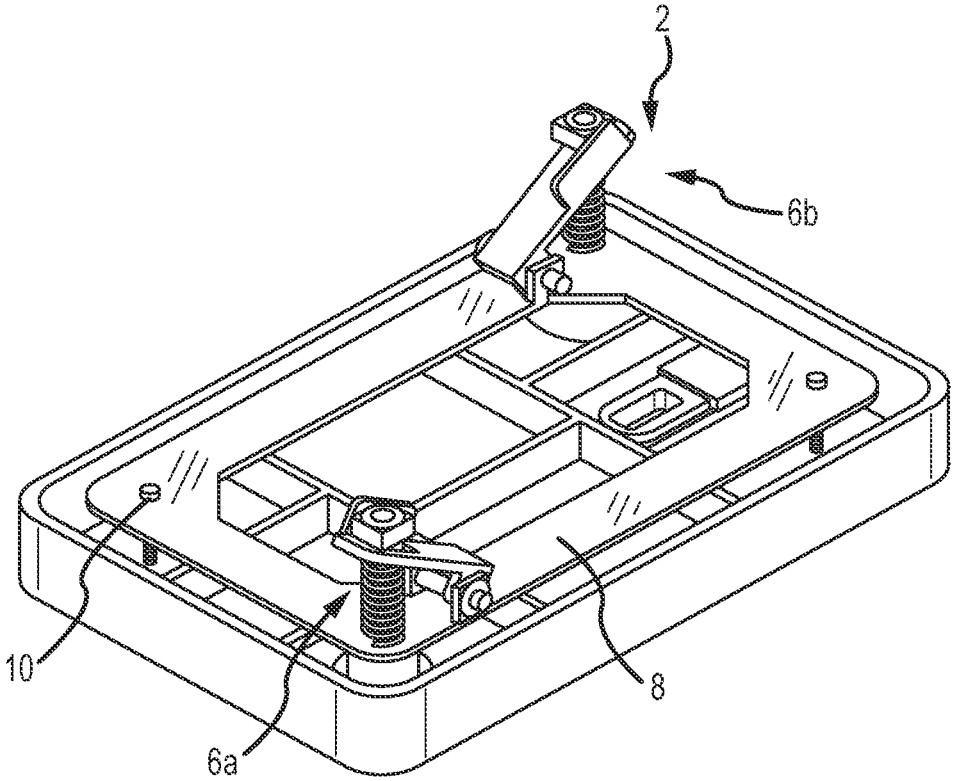
Figure 3A:
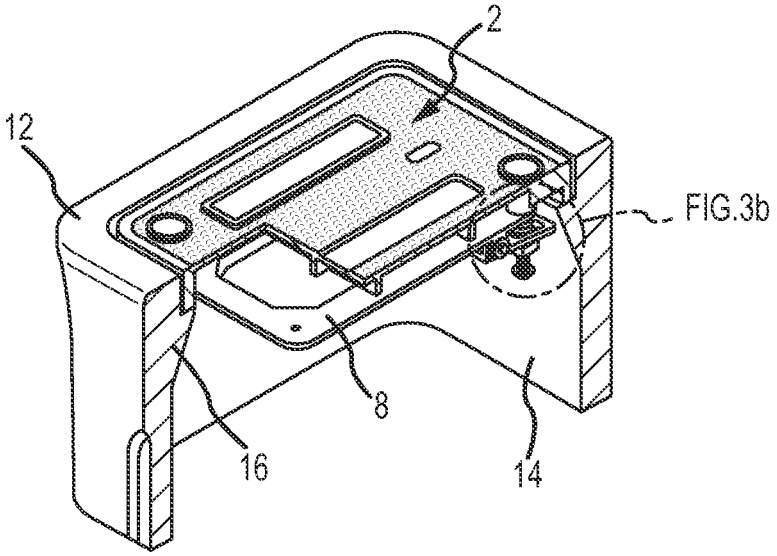
Figure 3B:
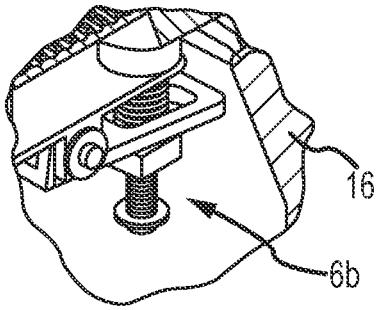
Figure 4A:
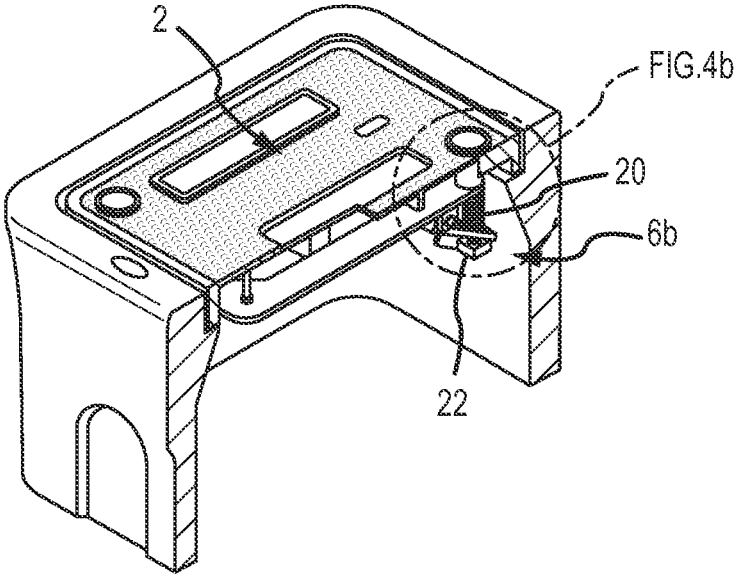
Figure 4B:
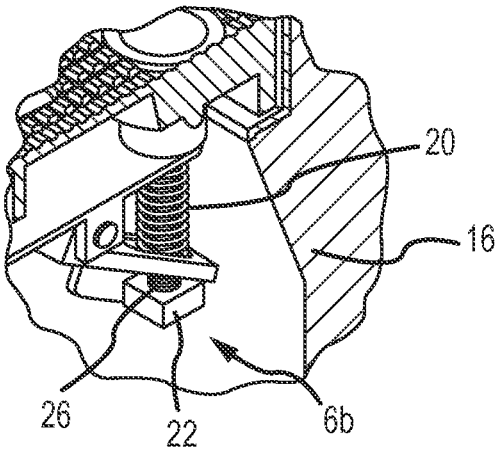
Figures 5A, 5B:
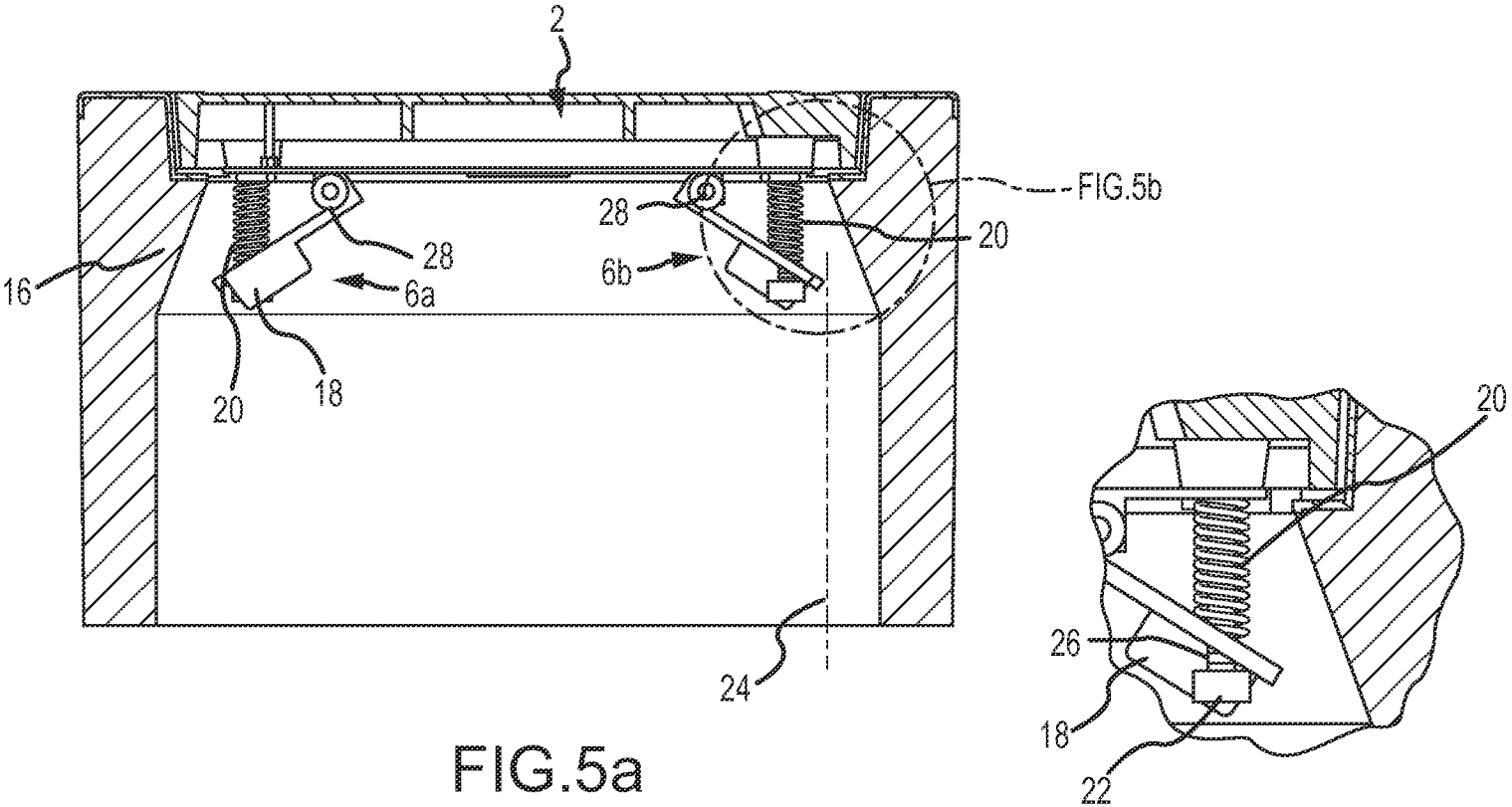
Figure 6:
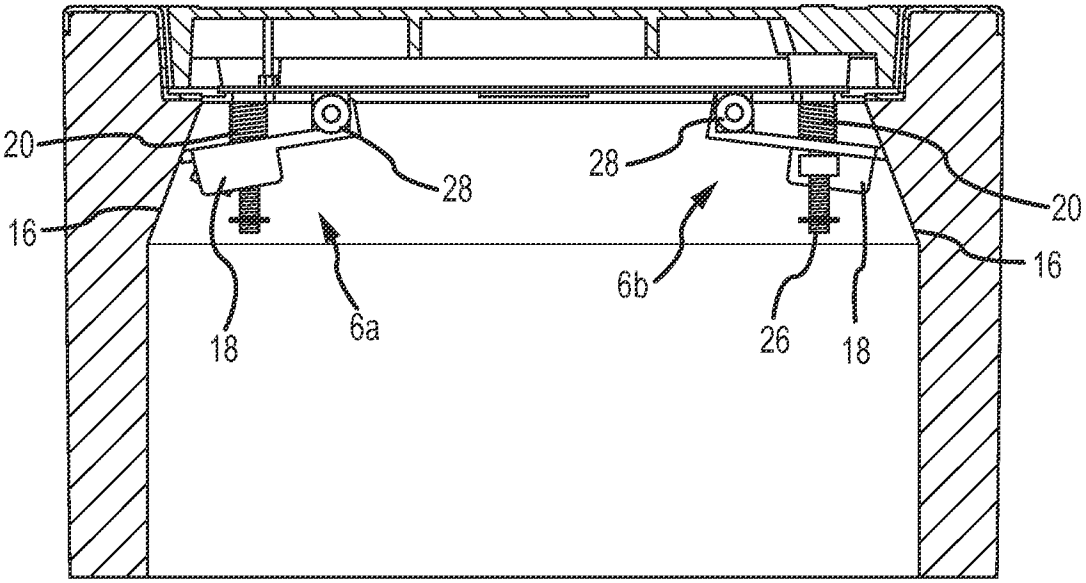
Figure 7:
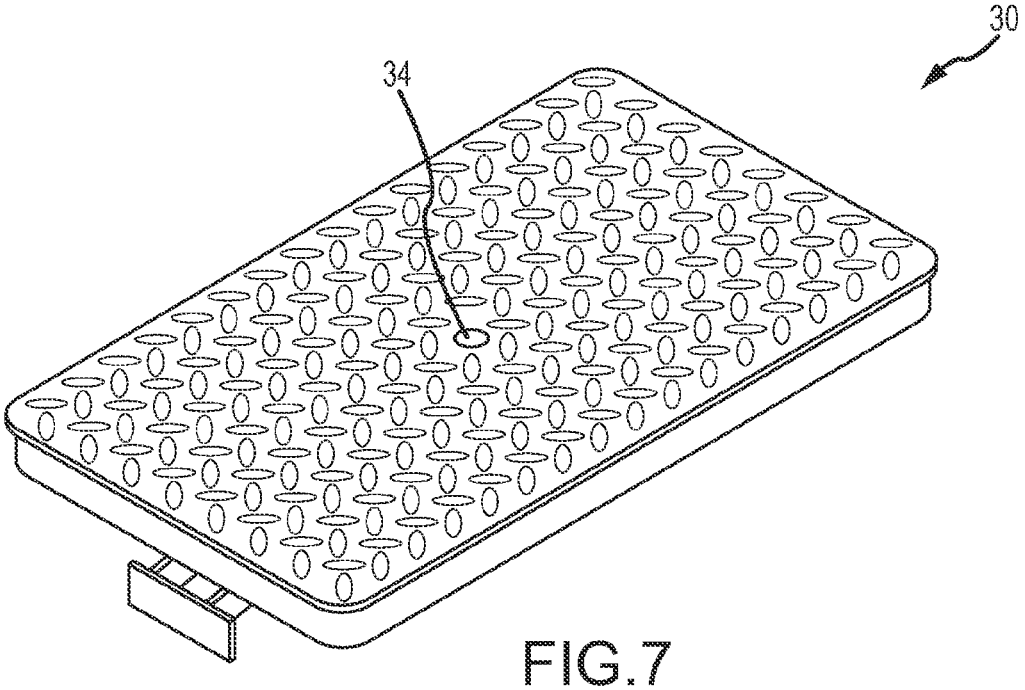
Figure 8:
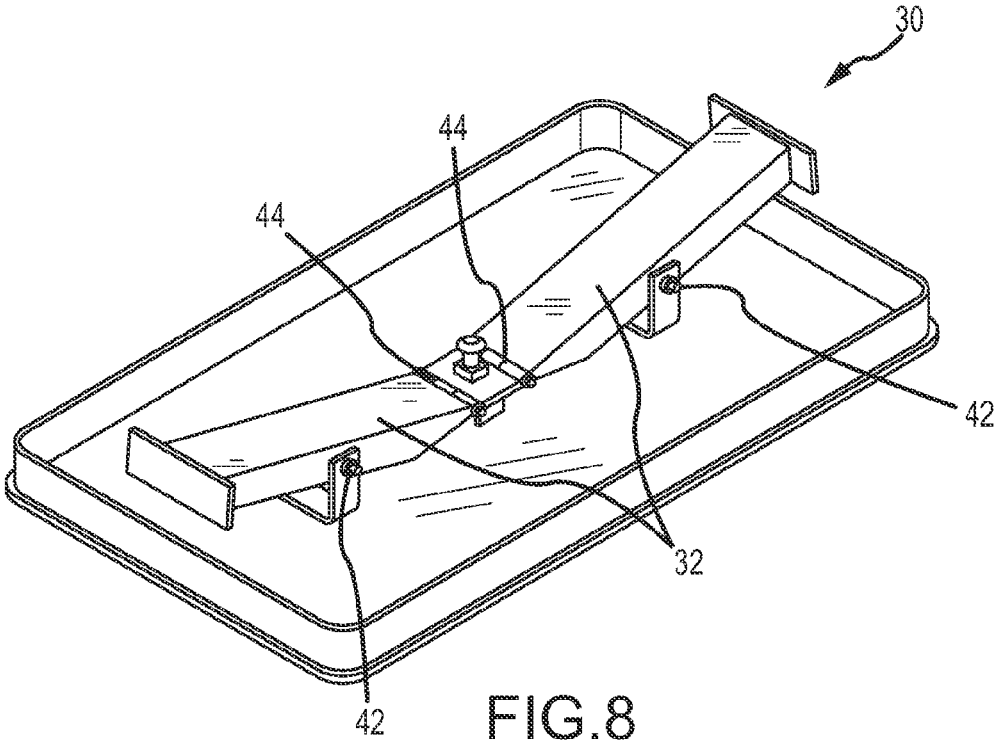
Figure 9A:
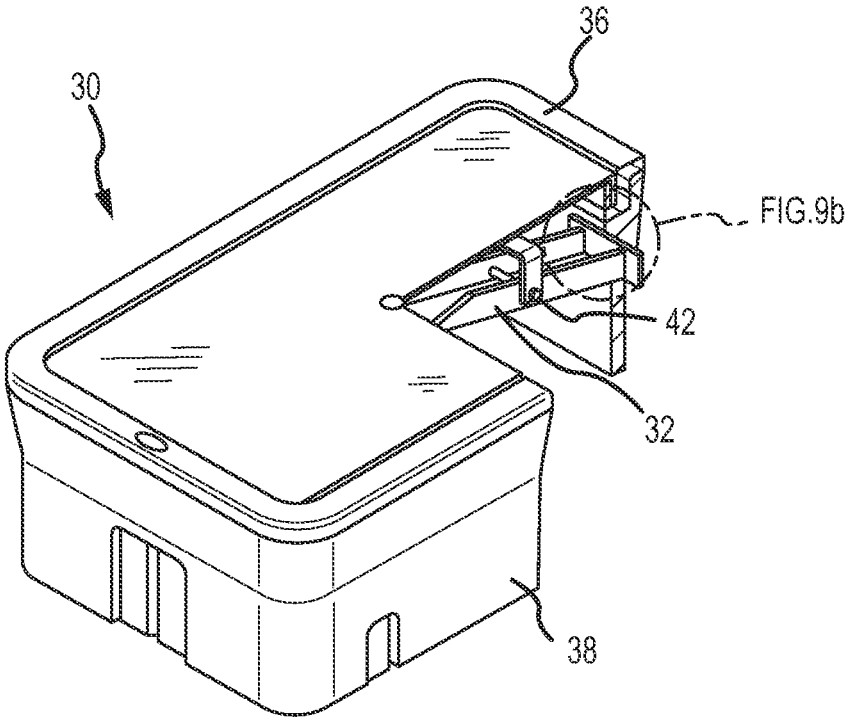
Figure 9B:
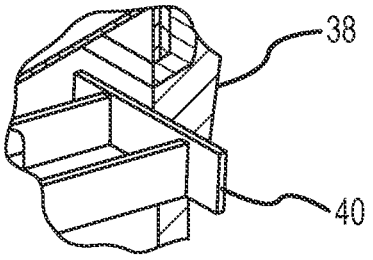
Figure 10A:
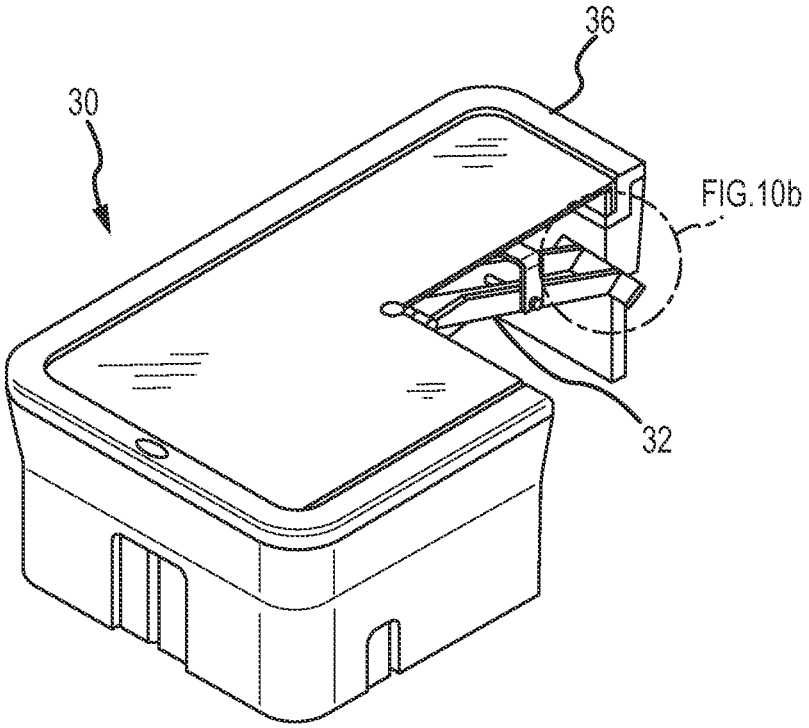
Figure 10B:
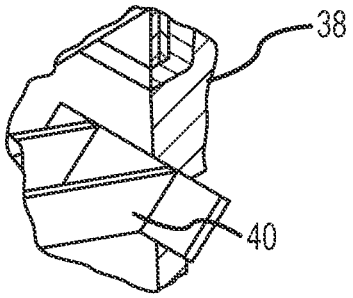
Figure 11A:
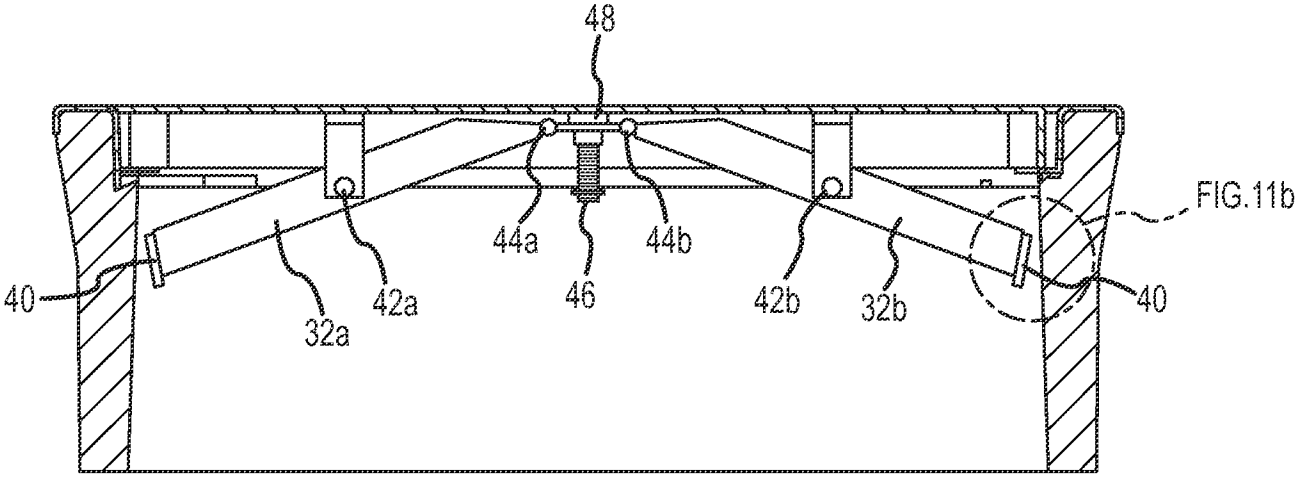
Figure 11B:
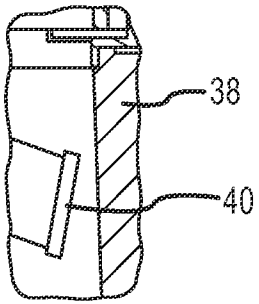
Figure 12:
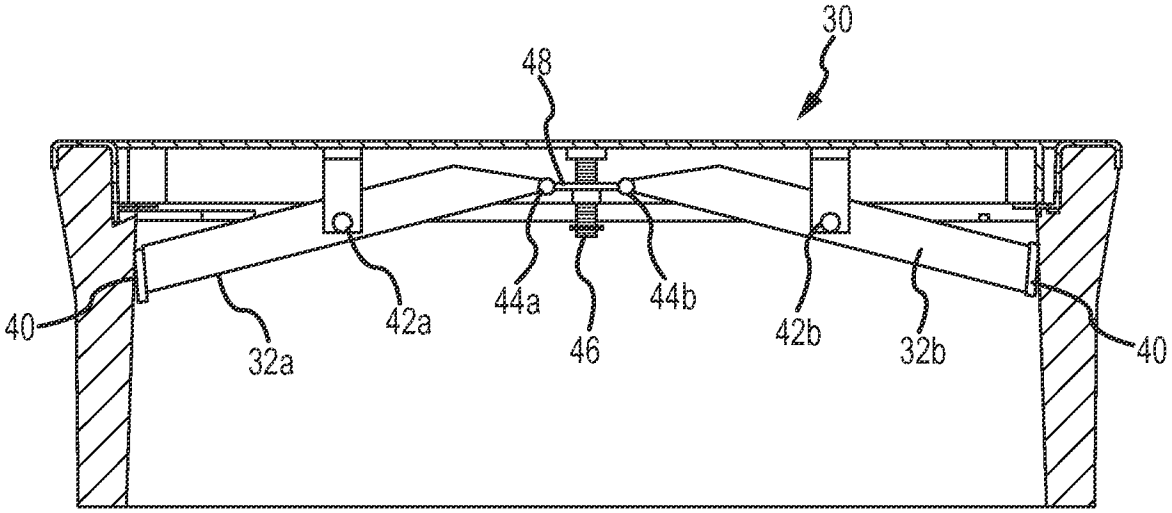
Figure 13B:
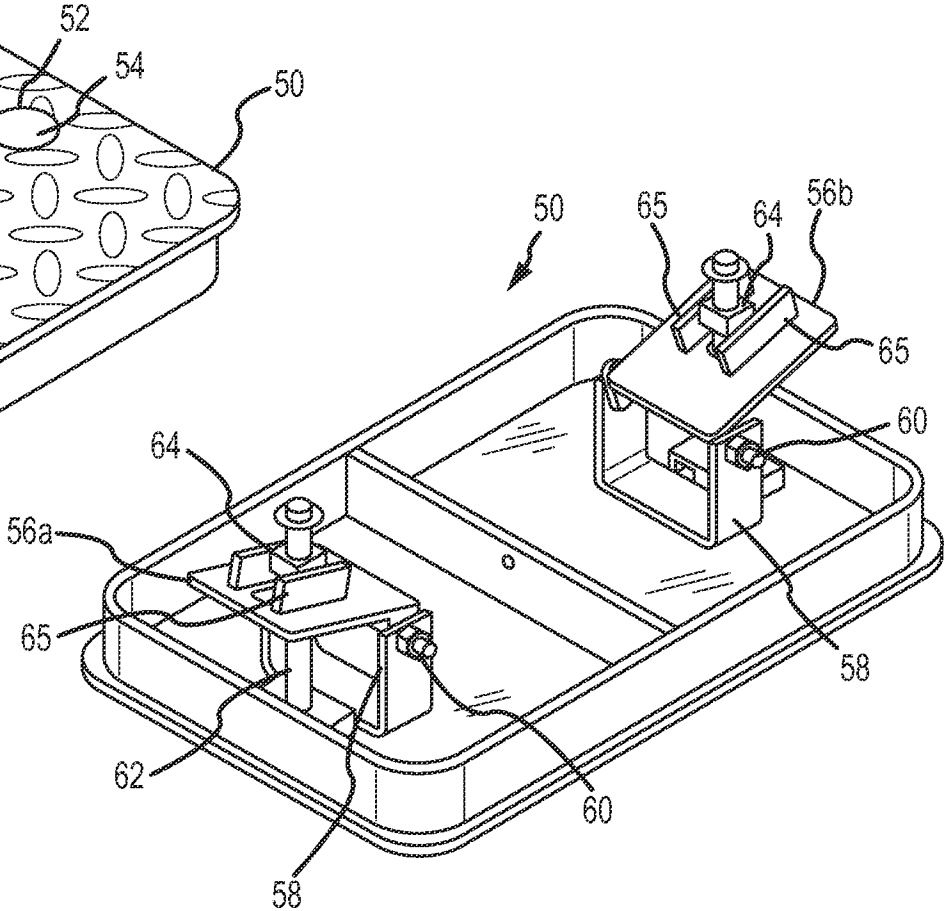
Figure 13A:
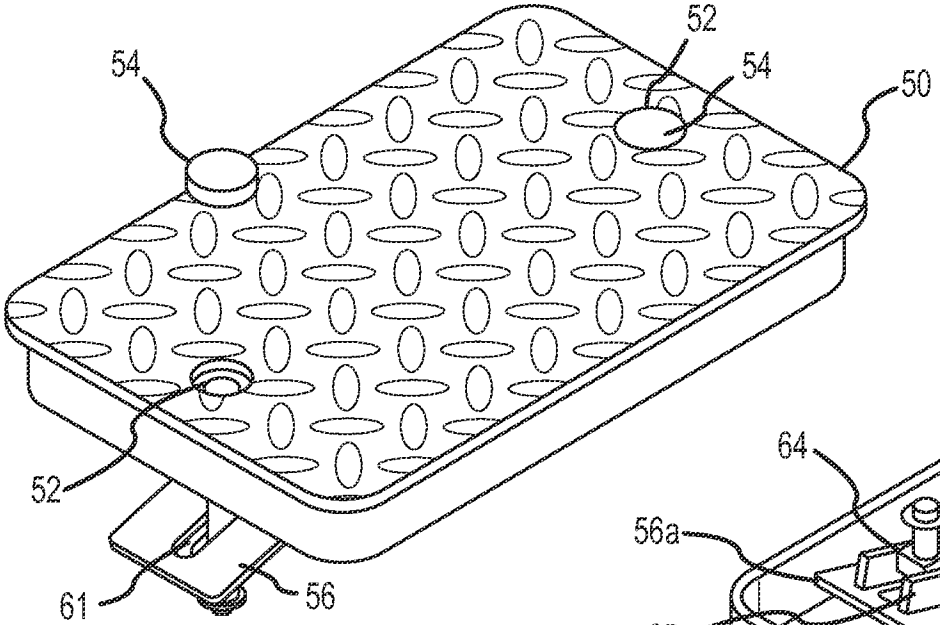

FIG. 1 is a top perspective view of a locking lid according to one embodiment of the present disclosure;

FIG. 2 is a bottom perspective view of the locking lid of FIG. 1;

FIG. 3*a* is a partially exploded top perspective view of the locking lid of FIG. 1;

FIG. 3*b* is a detailed top perspective view of the locking lid of FIG. 1;

FIG. 4*a* is a partially exploded top perspective view of the locking lid according the embodiment of FIG. 1;

FIG. 4*b* is a detailed top perspective view of the locking lid according to the embodiment of FIG. 1;

FIG. 5*a* is a cross-sectional front view of the embodiment of FIG. 1;

FIG. 5*b* is a detailed front elevation view of the embodiment of FIG. 1;

FIG. 6 is a cross-sectional front view of the embodiment of FIG. 1 taken at line 6-6 and depicting a subgrade vault and cap;

FIG. 7 is a top perspective view of a locking lid according to an alternative embodiment of the present disclosure;

FIG. 8 is a bottom perspective view of the locking lid of FIG. 7;

FIG. 9*a* is a partially exploded top perspective view of the locking lid according to the embodiment of FIG. 7;

FIG. 9*b* is a detailed top perspective view of the locking lid according to the embodiment of FIG. 7;

FIG. 10*a* is a partially exploded top perspective view of the locking lid according to the embodiment of FIG. 7;

FIG. 10*b* is a detailed top perspective view of the locking lid according to the embodiment of FIG. 7;

FIG. 11*a* is a cross-sectional front view of the embodiment of FIG. 7 with a cap attached to a subgrade vault;

FIG. 11*b* is a detailed front elevation view of the embodiment of FIG. 7;

FIG. 12 is a cross-sectional front view of the embodiment of FIG. 7;

FIG. 13*a* is top perspective view of a lid according to an alternative embodiment;

FIG. 13*b* is a bottom perspective view of the embodiment shown in FIG. 13*a;*

Figure 14C:
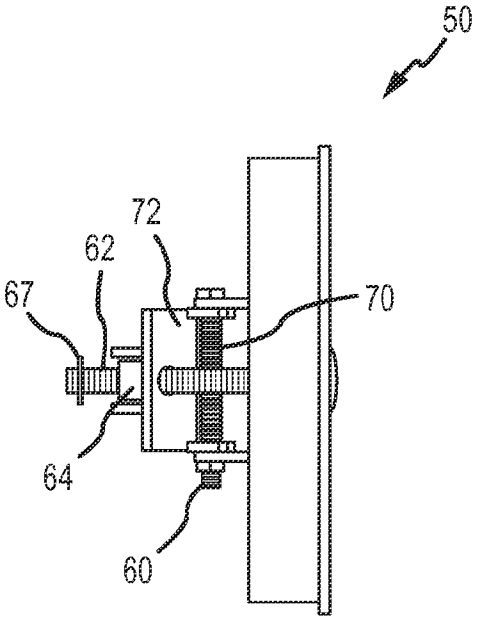
Figure 14A:
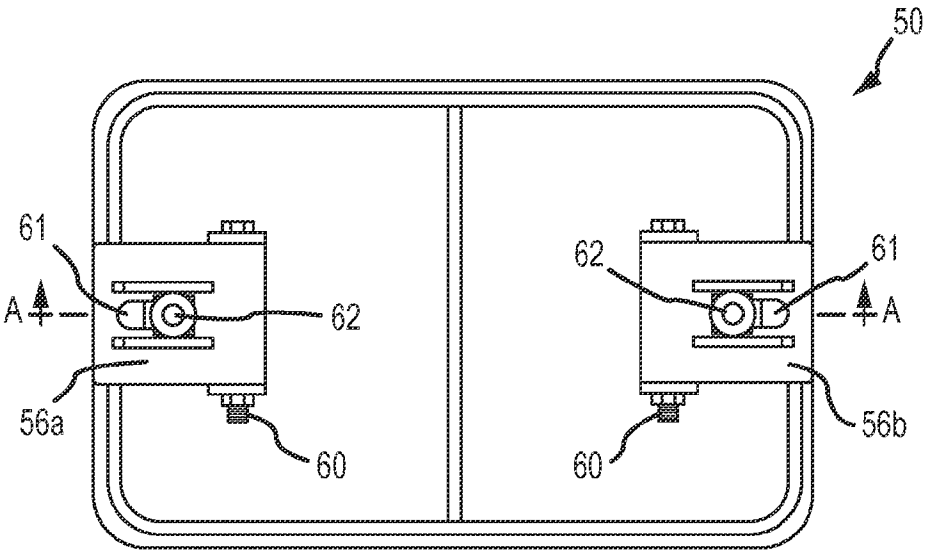

FIG. 14*a* is a bottom plan view of a lid according to the embodiment of FIG. 13*a;*

Figure 14B:
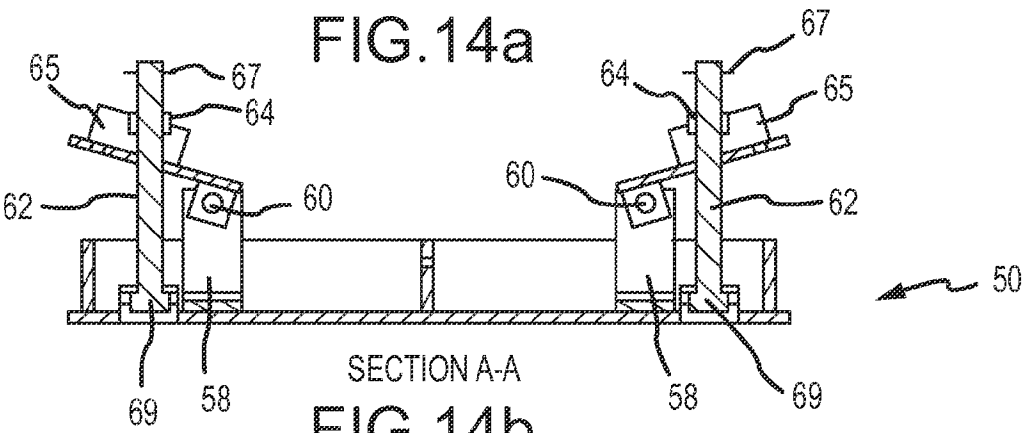

FIG. 14*b* is an elevation view of a lid according to the embodiment of FIG. 13*a*; and FIG. 14*c* is a side elevation view of a lid according to the embodiment of FIG. 13*a.*

DETAILED DESCRIPTION

The present invention provides its benefits across a broad spectrum of endeavors. It is applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.c. §112, sixth paragraph.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

FIGS. 1-2 depict a lid 2 adapted for use with a subgrade vault (not shown) according to one embodiment of the present disclosure. As shown, the lid 2 is sized to rest upon a shoulder or shelf portion of a cap of the subgrade vault, such that an upper surface of the lid is generally flush with upper portions of the cap when the lid 2 is in a closed position. The lid 2 is provided with at least one aperture, and preferably two apertures 4*a*, 4*b* adapted to align with a portion of locking elements 6*a*, 6*b*, as will be described in greater detail herein. Apertures 4*a*, 4*b* provides access to locking features of the present disclosure, while maintaining a substantially flush or flat upper surface of the lid 2.

In one embodiment, a security frame assembly 8 is provided on an underside or bottom of the lid 2. The security frame assembly 8 is preferably a substantially rigid steel frame structure which may be retrofitted to existing lids by standard connections, such as known fasteners 10.

Various embodiments of the present disclosure contemplate the use of tamper-proof or tamper-resistant fasteners, such that when a lid 2 is applied to a cap 12 and a fastener is employed to secure the lid 2, contents housed within a subgrade vault are generally inaccessible to those lacking the proper means (e.g. specialty tools). In various embodiments, selectively removable caps or covers are provided to protect fasteners from the elements, render them less obvious to potential trespassers, and/or create a more uniform and aesthetically pleasing upper portion of the lid 2.

As shown in FIG. 3*a*, a utility vault 14 comprises an internal storage volume defined by internal walls of the vault 14. An upper portion 16 of the vault is provided with an inward taper or angle such that an internal perimeter of the vault 14 at one vertical location is less than an internal perimeter of the vault 14 at a lower vertical location. Tapered portion 16 provides a locking surface for contact with additional lid features as shown and described herein.

Referring now to FIG. 3*b*, detail A of FIG. 3*a* is provided. As shown, the lid 2 is provided in a closed or locked position. Locking element 6*b* is oriented such that an interference fit is provided between the locking element 6*b* and a tapered portion 16 of the vault 14. The locking element 6*b* is selectively adjustable from an above-ground location to selectively position the locking element 6*b* between at least one locked and at least one unlocked position. The unlocked position of locking element 6*b* is depicted in FIGS. 4*a*-4*b*.

In the embodiment depicted in FIGS. 3*a*-4*b*, the locking element 6*b* comprises a threaded member and an at least partially restrained nut. Referring now to FIGS. 5*a*-5*b*, the locking elements 6*a*, 6*b* are shown in more detail. FIGS. 5*a*-5*b* show the elements 6*a*, 6*b* in an open position. The locking elements 6 comprise a flange member 18 for contacting a nut 22 disposed on a vertically oriented threaded member 26. A biasing element 20, such as a coil spring is provided in combination with the threaded member 26. For illustration purposes, a line 24 is provided to indicate a vertical plane. When locking members 6 are disposed in the open or lowered position of FIGS. 5*a* and 5*b*, the lid 2 may be lifted vertically upward and the locking elements pass through an upper opening or aperture of the vault. When the locking elements 6 are raised and thus rotated outwardly, at least a portion of the locking element(s) will extend beyond the boundary line 24 to a position where contact is made between the locking element 6 and the tapered portion(s) 16 of the vault, thus prohibiting removal of the lid.

In order to effect rotation of the locking elements 6 about hinges 28, a rotational force is imparted upon an upper portion of the threaded member 26, the upper portion being disposed above or within a thickness of the lid 2. The rotational force applied to the threaded member 26 further applies a rotational force upon the nut 22. However, rotational force upon the nut 22 is resisted and rotation of the nut 22 is substantially prevented by contact between the nut 22 and the flange 18. This resistance and prohibition on movement causes the nut 22 to translate along the length of the threaded member 26. As will be recognized by one of skill in the art, the direction of travel of the nut 22 will be dictated by the threading of the member 26 and the direction of rotation applied to the threaded member 26. Thus, when the appropriate rotation is applied to threaded member 26, a rotational force is applied to corresponding nut 22, whereupon rotation of the nut 22 is prevented by contact with flange 18 and the nut 22 translates upwardly, thus drawing locking element 6*b* to a closed position, the closed position characterized by at least a portion of the locking element 6*b* extending beyond boundary line 24.

The closed position of locking features 6*a*, 6*b* is shown in FIG. 6. As shown, the locking elements 6*a*, 6*b* are both drawn upwardly such that a portion of the substantially rigid locking element 6*a*, 6*b* contacts the tapered portion 16 of the vault 14. FIG. 6 depicts the springs 20 provided around the threaded member 26 in a compressed state. Springs 20 provide the necessary force to allow the locking elements 6*a*, 6*b* to be lowered or transitioned into an unlocked state (See FIG. 5). It will be appreciated that where the appropriate rotation is applied to the threaded member 26 to translate the nut 22 down the length of the threaded member 26, the nut 22 is not capable of rotating the member 6 downwardly. That is, some additional force is required to move the member 6 and prevent the nut 22 from simply extending below the member 6 and flange 18, where the nut 22 would rotate freely. In various embodiments, and as shown in FIGS. 1-6, this force is provided by coil spring 20. Thus, when rotation is applied to the threaded member as depicted in FIG. 6, interaction between the nut 22 and flange 18 with cause the nut to move downward. The rotatable locking member 6 tracks or follows the nut 22 due at least in part to a downward force applied by the coil spring 20. A flange or washer is provided on a lower end of the threaded member 26 in various embodiments to prevent the nut 22 from becoming detached from the threaded member 26.

FIGS. 7-8 are top and bottom perspective views of one embodiment of the present disclosure, respectively. As shown, a locking lid 30 for interconnection with a subgrade vault is provided. In the embodiment shown, two substantially rigid hinged locking arms 32 are provided for securing the lid 30. The hinged locking arms 32 are rotatable about hinges 33, 35 and may be accessed or controlled from a single above-grade or surface level access point 34. Hinged locking arms 32 are provided for communication with at least one internal surface of a corresponding subgrade vault. The locking arms 32 are rotatable between at least one open or unlocked position and at least one closed or locked position.

FIGS. 9*a*-9*b* depict a partial cut-away perspective view of the embodiment of FIGS. 7-8. The lid 30 and associated locking arms 32 are shown in connection with a cap 36 and subgrade vault structure 38. Although subgrade vault structures are generally depicted as comprising rectangular cubes, it will be expressly recognized that the present disclosure is not so limited. Indeed, vaults of various sizes, dimensions, and proportions are contemplated as within the scope and spirit of the present disclosure.

Locking arms 32 are each rotatable about at least one hinge 35, and preferably two hinges, such that they are selectively positionable between an open position and a closed or locked position.

Referring now to FIG. 11*a*-11*b*, locking arms 32*a*, 32*b* are shown in an open position. Each locking arm is provided with two hinges 42*a*, 44*a*, 42*b*, 44*b*. A substantially vertically oriented threaded member 46 is provided. Hinge members 44*a*, 44*b* are both hingedly connected to a translatable member 48 on the threaded member 46. In one embodiment, translatable member 48 comprises a flanged nut or similar threaded member. The rotation of the translatable member 48 is opposed (e.g. by interconnection to non-rotatable elements) such that rotation of the threaded member 46 produces linear movement of the nut 48 along the threaded member 46. Based on the hinged connections 42*a*, 44*a*, 42*b*, 44*b*, distal ends 40 are angularly displaced when the nut 48 is translated. Thus, translation of the translatable member 48 causes movement of the ends 40 of the locking arms 32 between at least a locked and an unlocked position.

FIG. 11*b* depicts a distal end 40 of a locking arm disposed in an open position. As shown, an approximately 3/16 inch clearance is provided between the narrowest portion of the vault 38 and the end of the locking arm 40. Various embodiments contemplate various gaps or spacing between locking elements and side walls of the vault. Various embodiments contemplate, for example, providing gaps between approximately 1/16 inches and 1 inch for an open position. Preferably, however, a sufficient tolerance is provided between locking elements and vault portions to accommodate for natural size changes of various components (e.g. due to thermal expansions/contractions, shifting of ground features and devices, etc.). Thus, preferred embodiments comprise gaps or tolerances of between approximately 3/16 inches and 1/2 inches.

FIG. 12 depicts a closed position of the locking arms 32*a*, 32*b* wherein the distal ends 40 of the locking arms are rotated or otherwise repositioned into a position of engagement with the interior of the vault. Vertical displacement (i.e. removal) of the lid 30 is thus prevented. As shown, the translatable member 48 has been lowered (with respect to FIG. 11*a*) such that the arms 32*a*, 32*b* have been rotated about pivot points 42*a*, 44*a*, 42*b*, 44*b* and the distal ends 40 brought into contact with the interior surfaces of the vault.

FIGS. 13*a* and 13*b* provide top and bottom perspective views of a lid according one embodiment of the present disclosure, respectively. As shown, a lid 50 comprises one or more apertures 52, which are selectively sealable by a plug member 54. Rotating locking arms 56*a*, 56*b* are provided on an underside of the lid 50. For each locking arm 56, a bracket 58 is provided, the bracket 58 being secured to the underside of the lid. The bracket 58 comprises a substantially rigid structure and receives the locking arm 56 in a rotatable manner about hinge point 60. The locking arm 56 is rotatably secured to the bracket 60 through any one of a variety of known means and devices, including, but not limited to, nut and bolt connections.

A control member 62 is provided which extends through a slot 61 in the locking arm 56. The control member 62 is contemplated as comprising, but is not limited to, a threaded rotatable member. The control member 62 of certain embodiments comprises a threaded member such as a bolt with a nut and wherein the rotation of the nut is opposed so as to facilitate translation of the nut along the length of the bolt. In alternative embodiments, the control member 62 comprises a worm gear for inducing rotational movement directly to a locking member 56. A top portion of the control member 62 is accessible from the aperture 52 provided in the top surface of the lid 50. When the control member 62 is rotated, a nut 64 is translated along the length of the control member 62 due in part to the nut being provided in a substantially fixed rotational position. Rotation of the nut 64 is at least partially restricted from rotation by contact with at least one flange member 65. Where rotation of the control member 62 is effected, yet rotation of the nut 64 is restricted, it will be recognized that the nut 64 will travel or creep along the length of the control member 64, similar to the features and functions described herein with respect to FIGS. 1-6. Such travel causes the locking arm 56 to rotate between a locked and an unlocked position by pivoting about hinge 60. The locked position is generally defined or characterized by the locking arm 56 being in a raised position such that a distal end of the locking arm contacts a sidewall of the vault and thus prevents removal of the associated lid. The unlocked position is generally defined or characterized by the locking arm 56 being in a lowered position such that a distal end of the locking arm is rotated away from a point of contact with the vault (i.e. either up or down) such that the lid may be removed without contact or interference between the arm 56 and an internal portion of the vault.

In certain embodiments, the locking arms 56 are provided with biasing members to bias the locking arms toward an open position. In one embodiment, at least one of the locking arms 56 is provided with a coil spring provided substantially coaxial with the control member 62. The coil spring serves to bias the locking arm 56 toward an open position such that when the nut 64 is rotated, rotation of the locking arm is facilitated. This may be particularly advantageous, for example, where the locking arm 56 has been brought securely into contact with a sidewall of the vault and the force of gravity alone is not sufficient to subsequently lower the locking arm 56. In another embodiment, a torsion spring is provided proximal a hinge point 60 of the locking 56 to bias the locking arm 56 toward an open position. For example, the torsion spring may be provided around a bolt 60 that defines the hinge point, with a portion of the torsion spring applying a downward force on an upper surface of the locking arm 56 and thereby biasing the locking arm 56 toward an open or unlocked position. In embodiments that comprise one or more biasing elements, it is contemplated that the biasing elements do not comprise sufficient force to move the nut 64 downwardly in the absence of additional input. That is, downward movement of the nut 64 requires rotation of the control member 62 wherein corresponding rotation of the nut 64 is opposed by a flange member 65. Downward movement or creep of the nut 64 is therefore induced and a corresponding downward movement of the locking arm 56 is facilitated by the biasing force provided by the biasing member.

In one embodiment, a coil spring is provided along a length of the threaded member to assist in downward movement of the locking arm 56 (see, e.g. FIG. 5*a*). Alternatively, one or more springs are provided at or proximal to the hinge point 60. For example, in one embodiment, a torsion spring is provided in the hinge point 60 to bias the locking arm 56 toward a lowered position. In various embodiments, threaded members of the present disclosure are provided in slots of the locking arm or feature to allow for rotation of the locking feature while the threaded member remains is a substantially fixed lateral position.

FIGS. 14*a*-14*c* provide bottom plan, side elevation, and cross-sectional views of the lid 50. The underside of the depicted lid 60 comprises two locking arms 56*a*, 56*b*, although alternative embodiments contemplate any number of locking arms, including a single locking arm and three or more locking arms. A slot 61 is provided in the rotatable locking arms 56*a*, 56*b* to allow for rotation about bolt 60 without interference from vertically disposed control member 62.

FIG. 14*b* is a cross-sectional view taken at section A-A of FIG. 14*a*. As shown, a pair of locking arms 56*a*, 56*b* are provided on corresponding brackets 58 and rotatable about a bolt 60 joining the respective arm 56 with the bracket 58. Control members 62 are provided and extend downwardly from a bottom surface of the lid 50. The control members 62 extend through slots in the locking members 56 and comprise a translatable member 64 for interaction with the locking member 56. Rotation of the translatable member 64, which preferably comprises a nut, is opposed by contact with a flange member 65 such that when rotation of the control member 62 is effected, this rotation induces a translational movement of the translatable member 64 along a length of the threaded member rather than a rotational movement about the axis of the control member 62. An upward (downward in FIG. 14*b*) movement of the translatable member 64 provides force to the locking member 56 and moves the locking member 56 into a locked position as shown and described herein. Rotational movement of the control member 62 may be accomplished by applying force to a head 69 of the control member 62, the head 69 being accessible through an aperture provided in an upper surface of the lid 50.

FIG. 14*c* is a side elevation view of the lid 50 of FIGS. 14*a*-14*b*. As shown, the bolt 60 which connects the locking member 56 to the bracket 58 and defines an axis of rotation of the locking arm 56 comprises a torsion spring 70. The torsion spring 70 comprises an extension for applying force to the locking member 56 and facilitating an unlocking operation of the locking member 56. One of skill in the art will recognize that as a control member 62 is rotated and the opposed nut 64 is translated along a length of the control member 62, the nut 64 serves to raise the locking member 56. When the nut is lowered through reverse rotation, however, it will be recognized that the locking member 56 may require some additional input or force to follow the nut 64 downwardly, particularly where the locking member 56 has been brought into contact with an internal side portion of a vault. The spring 70 provides this additional biasing force. The spring force of the spring 70 is not of sufficient magnitude, however, to move or translate the nut by itself. Rather, the spring 70 cooperates with a rotational movement of the control member 62 to lower the locking member 56. In various embodiments a washer or limiter 67 is provided at a distal end of the control member 62 to prevent the nut 64 from being inadvertently translated off of the control member 62.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure.

Moreover, though the present disclosure has included description of one or more embodiments and certain variations and modifications, other variations and modifications are within the scope of the disclosure, e.g. the use of a certain component described above alone or in conjunction with other components may comprise a system, while in other aspects the system may be the combination of all of the components described herein, and in different order than that employed for the purpose of communicating the novel aspects of the present disclosure. Other variations and modifications may be within the skill and knowledge of those in the art, after understanding the present disclosure. This method of disclosure is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A subgrade vault with a lid, comprising:

a body portion comprising four side walls which define an enclosure, an upper end, and a lower end;

at least one of the four sidewalls comprising an inward taper such that the vault comprises a first internal perimeter proximal the upper end and a second internal perimeter proximal the lower end, the first internal perimeter being less than the second internal perimeter;

the lid for closing the upper end, the lid comprising a top surface and a bottom surface and the bottom surface comprising at least one substantially rigid locking arm rotatable between a first position and a second position, the first position comprising an unlocked position and the second position comprising a locked position wherein the locking arm is provided in contact with the at least one sidewall comprising an inward taper;

a vertically disposed control member extending through at least a portion of the lid and provided in force-transmitting communication with the least one substantially rigid locking arm;

the substantially rigid locking arm comprising an elongate ovoid slot, and wherein the vertically disposed control member extends through the elongate ovoid slot and the elongate ovoid slot enables movement of the locking arm relative to the vertically disposed control member; and a biasing member in the form of a coil spring that biases the substantially rigid locking arm toward an open position such that rotation of the substantially rigid locking arm is facilitated when the vertically disposed control member is rotated, wherein the biasing member is provided around the vertically disposed control member and operable to lower the substantially rigid locking arm.

2. The subgrade vault of claim 1, further comprising a cap member operably interconnected to the upper end of at least one of the four side walls.

3. The subgrade vault of claim 1, wherein the vertically disposed control member comprises a threaded member, a first end of the threaded member being accessible from the top surface of said lid, and wherein rotation of said threaded member results in rotation of said locking arm between said first position and said second position.

4. The subgrade vault of claim 1, wherein said biasing member comprises a coil spring provided substantially coaxial with the vertically disposed control member.

5. The subgrade vault of claim 3, wherein the threaded member comprises a nut and wherein rotation of the nut is opposed such that rotation of the threaded member induces a movement of the nut along an axis of the threaded member.

6. The subgrade vault of claim 3, further comprising a washer fixed at a second end of the threaded member.

7. The subgrade vault of claim 3, wherein the lid comprises at least one aperture for accessing the first end of the threaded member.

8. A lid adapted for locking engagement with a subgrade vault to secure utility connections, said lid comprising:

an upper surface oriented in a substantially horizontal plane, a lower surface, a predetermined length, a width, and a height;

a locking member for releasably securing said lid to said subgrade vault, said locking member being rotatable with respect to said lid and provided on the lower surface of the lid;

said locking member having a predetermined length and being rotatable between at least a first unlocked position and a second locked position, said second locked position characterized by a distal end of the locking member being in force transmitting communication with an interior surface of said vault; and a control member comprising a proximal end and a distal end, said proximal end being accessible from the upper surface of said lid and the control member is adapted for rotating said locking member between said first position and said second position;

the control member provided substantially perpendicular to the upper surface of the lid;

the locking member comprising a planar portion with an elongate slot provided therein, and wherein the control member extends through the elongate slot; and a coil spring provided substantially coaxial with the control member and substantially perpendicular to said lower surface of said lid, the coil spring providing a downward force to the locking member to allow the locking member to be transitioned into an unlocked state.

9. The lid of claim 8, wherein activation of said control member results in rotation of said locking member between said first position and said second position.

10. The lid vault of claim 8, wherein the control member comprises a threaded member.

11. The subgrade vault of claim 8, wherein the coil spring is compressed when the locking member is in a locked position.

12. The subgrade vault of claim 8, wherein the control member comprises a threaded bolt and a nut and wherein rotation of the nut is opposed such that rotation of the threaded member induces a movement of the nut along an axis of the threaded member.

13. The subgrade vault of claim 12, further comprising a washer fixed at a second end of the threaded member.

14. The subgrade vault of claim 8, wherein the lid comprises at least one aperture for accessing the first end of the control member.

15. A subgrade vault assembly for providing an enclosed region to secure utility connections, said assembly comprising:

a lid comprising an upper surface oriented in a substantially horizontal plane, a lower surface, a length, a width, and a height;

a rotatable locking member positioned proximate to said lower surface of the lid and having a predetermined length and rotatable between at least a first unlocked position and a second locked position;

said rotatable locking member comprising a plate interconnected to a bracket, said bracket secured to said lower surface of said lid, and said plate comprising an elongate slot;

a rotatable bolt extending through at least a portion of the lid and through the elongate slot, the rotatable bolt comprising a nut adapted for contacting the rotatable locking member and effecting a movement of the rotatable locking member;

a coil spring provided substantially coaxially with the rotatable bolt and providing a force on the rotatable locking member, the force comprising a downward force to allow the rotatable locking member to transition to an unlocked state, and wherein the coil spring is provided in a compressed state when the rotatable locking element is provided in a locked position;

a vault having a body portion comprising four side walls which define an enclosure, an upper end, and lower end, and at least one of the four sidewalls comprising an inward taper such that the vault comprises a first internal perimeter proximal the upper end and a second internal perimeter proximal the lower end, the first internal perimeter being less than the second internal perimeter;

said rotatable locking member being rotatable between the first unlocked position and the second locked position, said second locked position characterized by a distal end of the rotatable locking member being in force transmitting communication with an interior surface of a sidewall of said vault such that said lid and said vault are securely interconnected when said rotatable locking member is provided in said second position.

16. The subgrade vault of claim 15, wherein a first end of the bolt is accessible from the top surface of said lid, and wherein rotation of said bolt results in rotation of said locking member between said first unlocked position and said second locked position.

17. The subgrade vault of claim 15, wherein said coil spring biases the locking member toward the first unlocked position.

18. The subgrade vault of claim 15, wherein rotation of the nut is opposed such that rotation of the threaded member induces a movement of the nut along an axis of the threaded member to engage the rotatable locking member.

19. The subgrade vault of claim 15, wherein the lid comprises at least one aperture for accessing the first end of the threaded member such that rotation of the locking member may be effected from an exterior of the vault.

20. The subgrade vault of claim 15, wherein the vault is comprised of at least one of a precast concrete material, a fiberglass, a plastic material, and a cement material.

* * * * *